US011029638B2

(12) United States Patent
Sato

(10) Patent No.: US 11,029,638 B2
(45) Date of Patent: Jun. 8, 2021

(54) IMAGE FORMING APPARATUS

(71) Applicant: BROTHER KOGYO KABUSHIKI KAISHA, Nagoya (JP)

(72) Inventor: Shougo Sato, Seto (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/000,618

(22) Filed: Aug. 24, 2020

(65) Prior Publication Data

US 2021/0063956 A1 Mar. 4, 2021

(30) Foreign Application Priority Data

Sep. 2, 2019 (JP) ..... JP2019-159902

(51) Int. Cl.
*G03G 15/04* (2006.01)
*G03G 21/16* (2006.01)

(52) U.S. Cl.
CPC ..... *G03G 21/1676* (2013.01); *G03G 21/1647* (2013.01)

(58) Field of Classification Search
CPC ..... G03G 21/1647; G03G 21/1676; G03G 21/1842; G03G 21/1864; G03G 2221/1684; G03G 2221/1869
USPC ..... 399/107, 110, 111, 119, 120
See application file for complete search history.

(56) References Cited

U.S. PATENT DOCUMENTS 8,837,982 B2 * 9/2014 Matsuda ..... G03G 21/1647 399/111
9,020,392 B2 * 4/2015 Hashimoto ..... G03G 15/0194 399/110
2016/0139558 A1 5/2016 Kawakami et al.
2016/0154341 A1 6/2016 Hamada et al.

FOREIGN PATENT DOCUMENTS

JP 2016-99403 A 5/2016
JP 2016-110097 A 6/2016

* cited by examiner

*Primary Examiner* — Hoan H Tran
(74) *Attorney, Agent, or Firm* — Merchant & Gould P.C.

(57) ABSTRACT

An image forming apparatus includes: a drawer movable between an inside position and an outside position; a drum cartridge including a photoconductive drum rotatable about a first axis; and a developing cartridge including a developing roller rotatable about a second axis. The drum cartridge includes a first developing-roller guide pivotable between a first position where the first developing-roller guide guides the developing roller when the developing cartridge is mounted on the drawer with the drum cartridge being mounted on the drawer, and a second position where the first developing-roller guide guides the developing roller with the drum cartridge and the developing cartridge being mounted on the drawer. The second axis is located below the first axis in a state in which the drum cartridge and the developing cartridge are mounted on the drawer, and the first developing-roller guide is located at the second position.

17 Claims, 13 Drawing Sheets

IMAGE FORMING APPARATUS

CROSS REFERENCE TO RELATED APPLICATION

The present application claims priority from Japanese Patent Application No. 2019-159902, which was filed on Sep. 2, 2019, the disclosure of which is herein incorporated by reference in its entirety.

BACKGROUND

The following disclosure relates to an image forming apparatus.

There have been known image forming apparatuses including a drawer and a process cartridge. The drawer is movable between an inside position at which the drawer is located inside a housing, and an outside position at which the drawer is located outside the housing. The process cartridge stores toner. The process cartridge includes a photoconductive drum and a developing roller. The process cartridge is mountable on the drawer.

SUMMARY

In such image forming apparatuses, in the case where a remaining amount of the toner in the process cartridge is small, the entire process cartridge including the photoconductive drum needs to be replaced even if there is no need to replace the photoconductive drum. This makes it difficult to reduce the cost of using the image forming apparatus.

Accordingly, an aspect of the disclosure relates to an image forming apparatus allowing a developing cartridge including a developing roller to be replaced in a state in which a drum cartridge including a photoconductive drum is mounted on a drawer.

In one aspect of the disclosure, an image forming apparatus includes: a housing; a drawer movable between an inside position at which the drawer is located inside the housing, and an outside position at which the drawer is located outside the housing; a drum cartridge mountable on the drawer and including a photoconductive drum rotatable about a first axis; and a developing cartridge mountable on the drawer and including a developing roller rotatable about a second axis. The drum cartridge includes a first developing-roller guide pivotable between (i) a first position at which the first developing-roller guide guides the developing roller when the developing cartridge is mounted on the drawer in a state in which the drum cartridge is mounted on the drawer, and (ii) a second position at which the first developing-roller guide guides the developing roller in a state in which the drum cartridge and the developing cartridge are mounted on the drawer. The second axis of the developing roller is located below the first axis of the photoconductive drum in a state in which the drum cartridge and the developing cartridge are mounted on the drawer, and the first developing-roller guide is located at the second position.

In another aspect of the disclosure, an image forming apparatus includes: a housing; a drawer movable between an inside position at which the drawer is located inside the housing, and an outside position at which the drawer is located outside the housing; a drum cartridge including a photoconductive drum rotatable about a first axis; a developing cartridge including a developing roller rotatable about a second axis; and a first developing-roller guide configured to guide the developing roller and pivotable, in a state in which the drum cartridge is mounted on the drawer, between (i) a first position at which mounting and removal of the developing cartridge to and from the drawer are allowed and (ii) a second position at which mounting and removal of the developing cartridge to and from the drawer are not allowed, and a position of the developing roller is lower than that when the first developing-roller guide is located at the first position.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENT

Hereinafter, there will be described one embodiment by reference to the drawings. It is to be understood that the following embodiment is described only by way of example, and the disclosure may be otherwise embodied with various modifications without departing from the scope and spirit of the disclosure.

1. Overall Configuration of Image Forming Apparatus 1

There will be described an overall configuration of an image forming apparatus 1 with reference to FIGS. 1 and 2.

Figure 1:
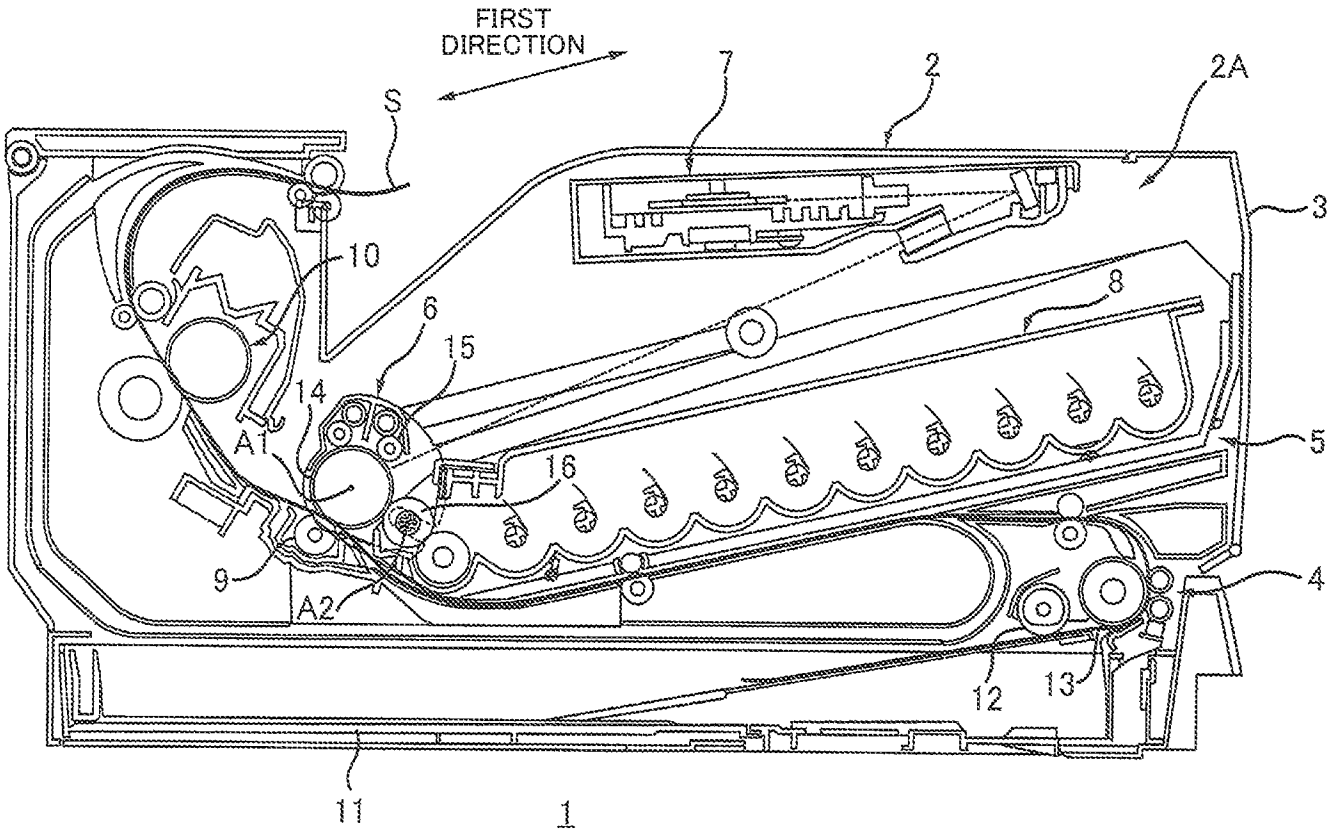
FIG. 1 is a schematic view of an image forming apparatus.

As illustrated in FIG. 1, the image forming apparatus 1 includes a housing 2, a cover 3, a sheet supplier 4, a drawer 5, a drum cartridge 6, an exposing device 7, a developing cartridge 8, a transfer roller 9, and a fixing device 10. It is noted that the image forming apparatus 1 is for monochrome printing. Thus, the image forming apparatus 1 includes one drum cartridge 6 and one developing cartridge 8.

1.1. Housing 2 and Cover 3

The housing 2 accommodates the sheet supplier 4, the drawer 5, the drum cartridge 6, the exposing device 7, the developing cartridge 8, the transfer roller 9, and the fixing device 10. The housing 2 has an opening 2A.

The cover 3 is mounted on the housing 2. The cover 3 is movable between a closed position (see FIG. 1) and an open position (see FIG. 2). When the cover 3 is located at the closed position, the cover 3 closes the opening 2A. When the cover 3 is located at the open position, the opening 2A is open.

1.2. Sheet Supplier 4

The sheet supplier 4 includes a sheet cassette 11, a pickup roller 12, and a conveying roller 13. The sheet cassette 11 accommodates sheets S. The pickup roller 12 conveys the sheet S stored in the sheet cassette 11, toward the conveying roller 13. The conveying roller 13 conveys the sheet S supplied from the pickup roller 12, toward the transfer roller 9.

1.3. Drawer 5

The drawer 5 supports the drum cartridge 6 and the developing cartridge 8. The drawer 5 is movable in a first direction between an inside position (see FIG. 1) and the outside position (see FIG. 2). The first direction intersects the up and down direction. The drawer 5 moves upward while moving from the inside position to the outside position. The drawer 5 passes through the opening 2A when the drawer 5 moves between the inside position and the outside position.

Figure 2:
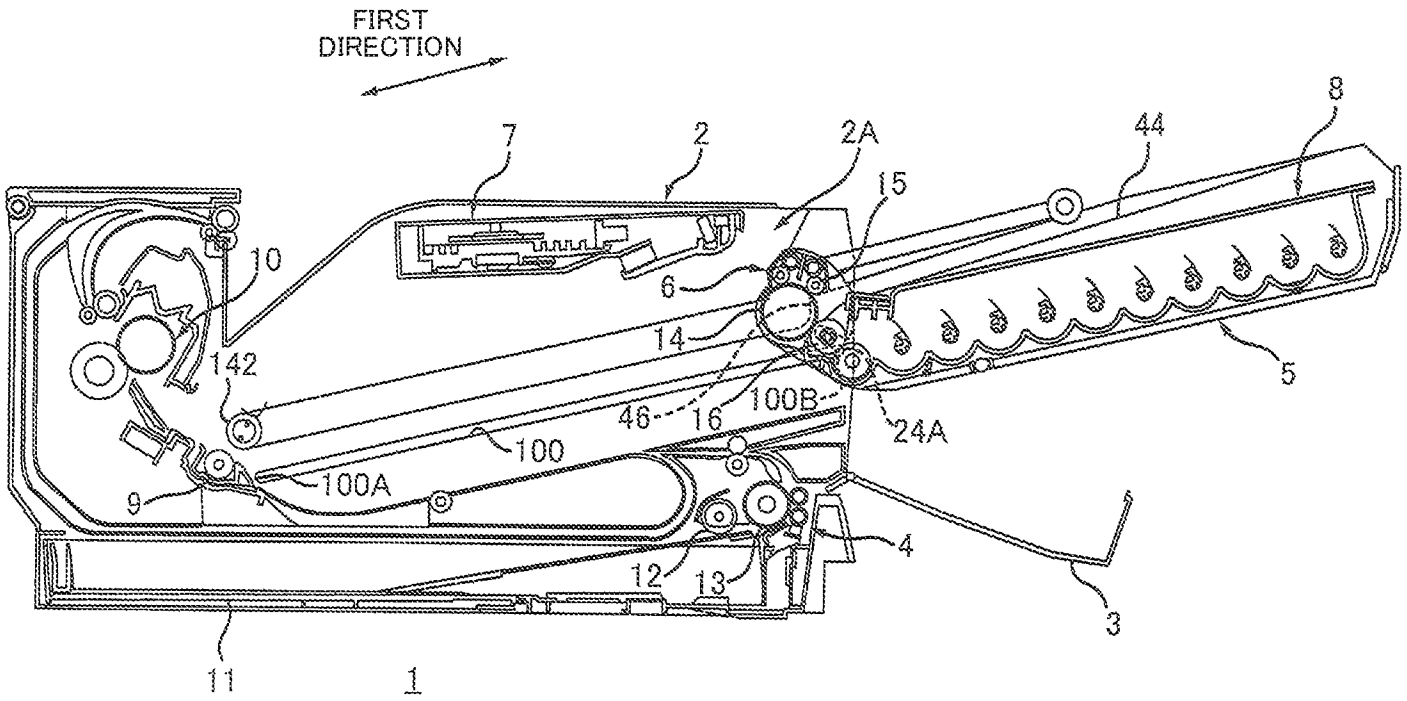
FIG. 2 is a schematic view of the image forming apparatus, illustrating a state in which a drawer is located at an outside position.

Specifically, as illustrated in FIG. 2, the image forming apparatus 1 includes a body guide 100. The body guide 100 is provided in the housing 2. The body guide 100 extends in the first direction. The body guide 100 includes a first end portion 100A and a second end portion 100B in the first direction. The first end portion 100A is located between the transfer roller 9 and the second end portion 100B in the first direction. A guided portion 32A of the drawer 5 (see FIG. 8) is fittable to the body guide 100. The guided portion 32A will be described later in detail.

As illustrated in FIG. 1, the guided portion 32A is fitted to the first end portion 100A of the body guide 100 in a state in which the drawer 5 is located at the inside position. As illustrated in FIG. 2, the guided portion 32A is fitted to the second end portion 100B of the body guide 100 in a state in which the drawer 5 is located at the outside position. When the drawer 5 is located at the inside position, the entire drawer 5 is located inside the housing 2. When the drawer 5 is located at the outside position, at least a portion of the drawer 5 is located outside the housing 2.

1.4. Drum Cartridge 6

As illustrated in FIG. 1, the drum cartridge 6 includes a photoconductive drum 14 and a charged roller 15. The drum cartridge 6 is mountable on the drawer 5 in the state in which the drawer 5 is located at the outside position (see FIG. 2).

The photoconductive drum 14 is rotatable about a first axis A1 extending in an axial direction. The axial direction intersects the first direction and the up and down direction. The axial direction is preferably orthogonal to the first direction and the up and down direction. The photoconductive drum 14 extends in the axial direction. The photoconductive drum 14 has a cylindrical shape.

The charged roller 15 charges a circumferential surface of the photoconductive drum 14. The charged roller 15 contacts the circumferential surface of the photoconductive drum 14. It is noted that the drum cartridge 6 may include a scorotron charging device instead of the charged roller 15.

1.5. Exposing Device 7

The exposing device 7 exposes the circumferential surface of the photoconductive drum 14 which is charged by the charged roller 15. This forms a latent image on the circumferential surface of the photoconductive drum 14. Specifically, the exposing device 7 is a laser scanning unit.

1.6. Developing Cartridge 8

The developing cartridge 8 is mountable on the drawer 5 in the state in which the drawer 5 is located at the outside position (see FIG. 2). The developing cartridge 8 stores toner to be supplied to the photoconductive drum 14. The developing cartridge 8 includes a developing roller 16.

The developing roller 16 is rotatable about a second axis A2 (see FIG. 1) extending in the axial direction. The developing roller 16 is in contact with the photoconductive drum 14 in a state in which the drum cartridge 6 and the developing cartridge 8 are mounted on the drawer 5. The developing roller 16 is capable of supplying the toner from the developing cartridge 8 to the photoconductive drum 14 in the state in which the developing roller 16 is in contact with the photoconductive drum 14. As a result, the latent image formed in the photoconductive drum 14 is developed, so that a toner image is formed on the circumferential surface of the photoconductive drum 14.

1.7. Transfer Roller 9

The transfer roller 9 is in contact with the photoconductive drum 14 in a state in which the drum cartridge 6 is mounted on the drawer 5, and the drawer 5 is located at the inside position. The sheet S supplied from the sheet cassette 11 passes through a position between the transfer roller 9 and the photoconductive drum 14. In this operation, the transfer roller 9 transfers the toner image formed in the circumferential surface of the photoconductive drum 14, to the sheet S.

1.8. Fixing Device 10

The fixing device 10 heats and pressurizes the sheet S to which the toner image has been transferred, to fix the toner image transferred from the photoconductive drum 14 to the sheet S, to the sheet S. The sheet S having passed through the fixing device 10 is discharged onto an upper surface of the housing 2.

2. Details of Developing Cartridge 8

Figure 3:
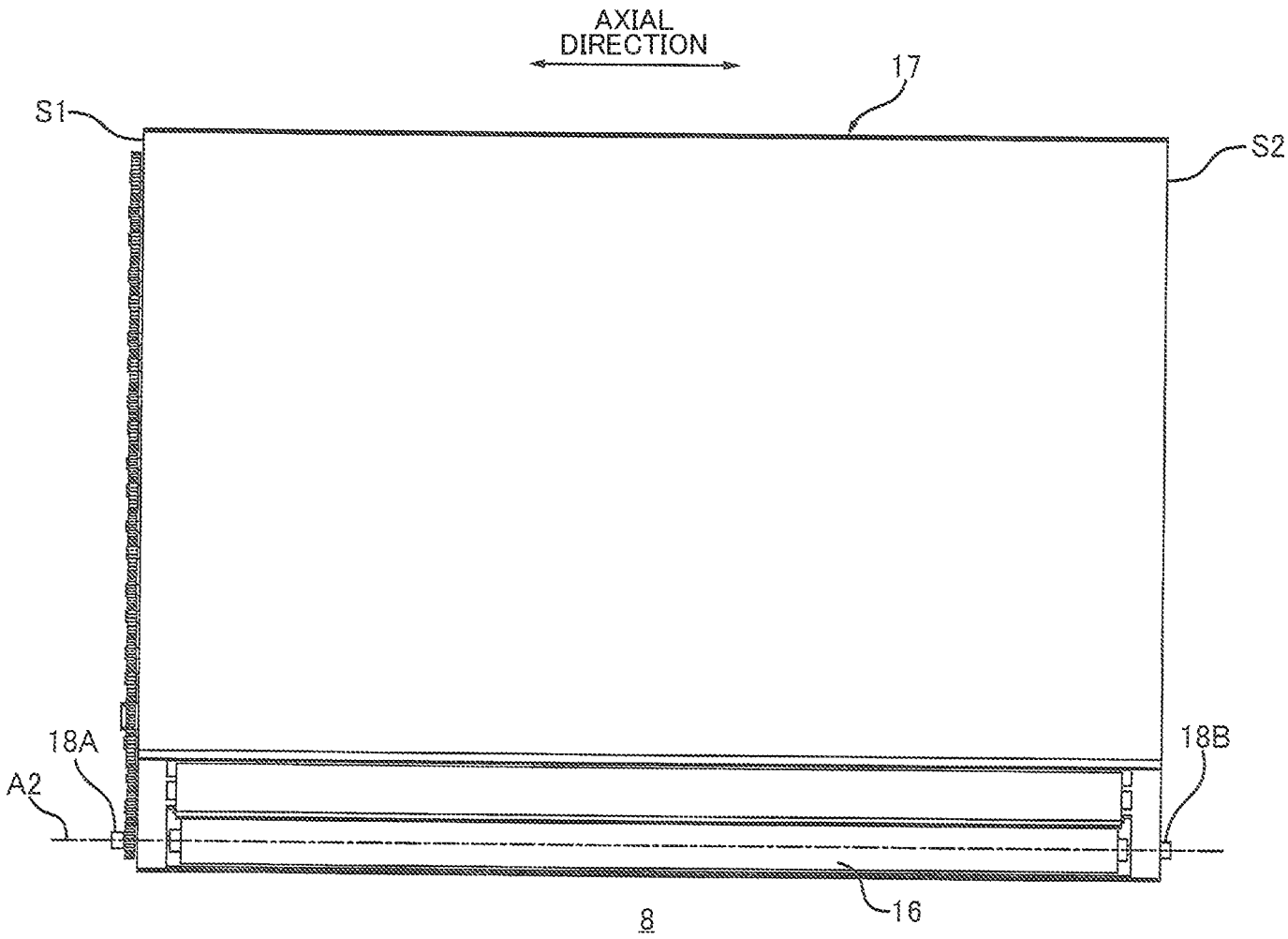
FIG. 3 is a plan view of a developing cartridge.

There will be next described the developing cartridge 8 in detail with reference to FIG. 3.

The developing cartridge 8 includes a development housing 17 and guided portions 18A, 18B in addition to the developing roller 16. At least a portion of the developing cartridge 8 is located outside the housing 2 in the state in which the drum cartridge 6 and the developing cartridge 8 are mounted on the drawer 5, and the drawer 5 is located at the outside position (see FIG. 2).

2.1. Development Housing 17

The development housing 17 stores toner. The developing roller 16 is mounted on the development housing 17. The development housing 17 extends in the axial direction. The development housing 17 has a first outer surface S1 and a second outer surface S2 in the axial direction. The outer surface S2 is located apart from the outer surface S1 in the axial direction.

2.2. Guided Portion 18A

The guided portion 18A is located on the outer surface S1 of the development housing 17. The guided portion 18A is a protrusion. The guided portion 18A extends in the axial direction. The guided portion 18A has a cylindrical shape. The guided portion 18A extends along the second axis A2. The guided portion 18A is fitted to a developing-roller guide 24A of the drum cartridge 6 (see FIG. 5A) in the state in which the drum cartridge 6 and the developing cartridge 8 are mounted on the drawer 5. The developing-roller guide 24A will be described later in detail. The guided portion 18A is guided by the developing-roller guide 24A.

In this embodiment, an end portion of the shaft of the developing roller 16 is fitted in the guided portion 18A. Specifically, the shaft of the developing roller 16 extends along the second axis A2. The shaft of the developing roller 16 has: a first end portion in the axial direction; and a second end portion located apart from the first end portion in the axial direction. The first end portion of the shaft of the developing roller 16 is fitted in the guided portion 18A. It is noted that the guided portion 18A may be the first end portion of the shaft of the developing roller 16. The shaft of the developing roller 16 may not be fitted to the guided portion 18A.

2.3. Guided Portion 18B

The guided portion 18B is located on the outer surface S2 of the development housing 17. The guided portion 18B is located apart from the guided portion 18A in the axial direction. The guided portion 18B is located on an opposite side of the development housing 17 from the guided portion 18A in the axial direction. In other words, the development housing 17 is located between the guided portion 18A and the guided portion 18B in the axial direction. The guided portion 18B is fitted to a developing-roller guide 24B of the drum cartridge 6 (see FIG. 5B) in a state in which the developing cartridge 8 is mounted on the drawer 5. The guided portion 18B is guided by the developing-roller guide 24B. The guided portion 18B is similar in construction to the guided portion 18A, and an explanation of the guided portion 18B is dispensed with.

3. Details of Drum Cartridge 6

There will be next described the drum cartridge 6 in detail with reference to FIGS. 4-7B.

Figure 4:
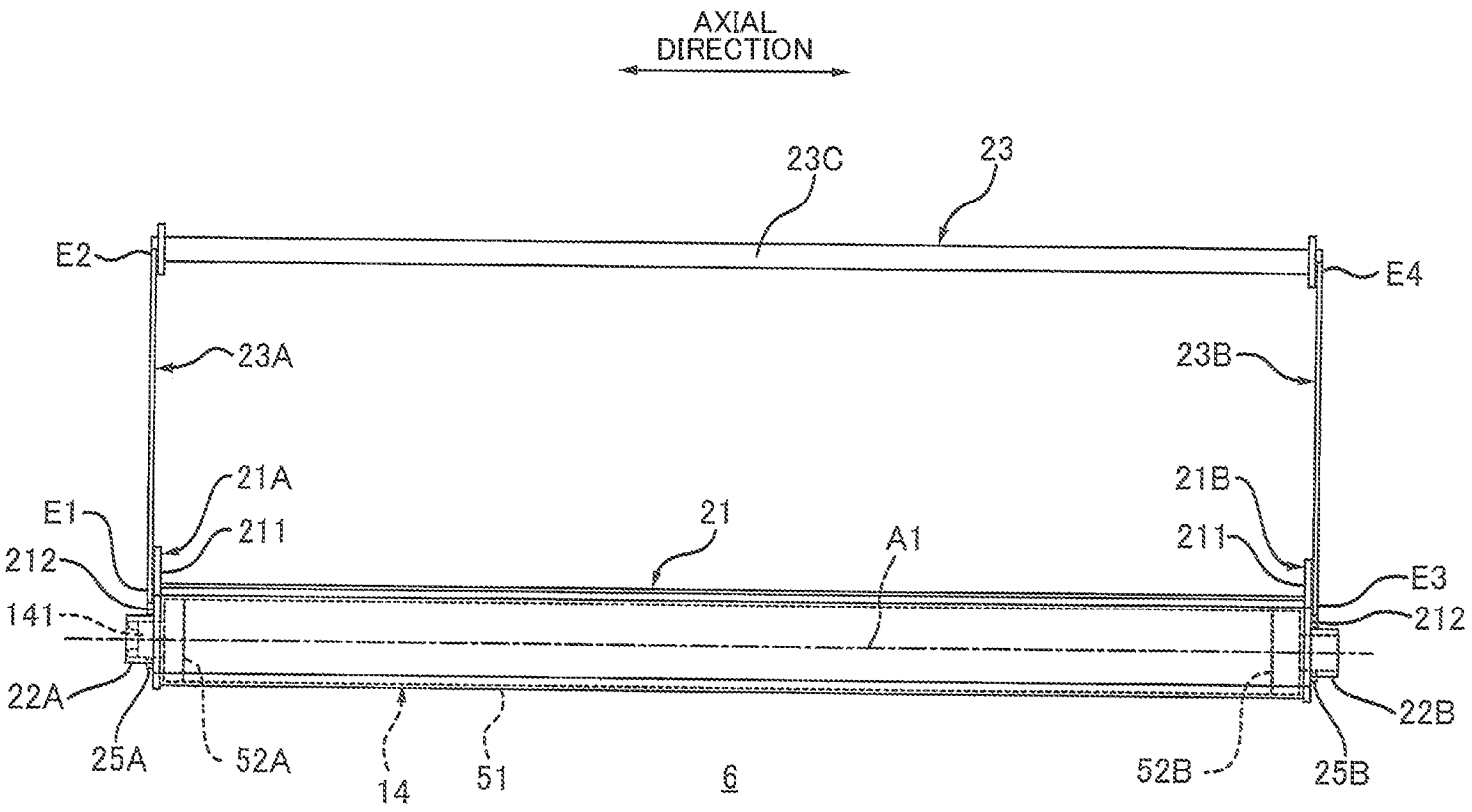
FIG. 4 is a plan view of a drum cartridge.

As illustrated in FIG. 4, the drum cartridge 6 extends in the axial direction. In addition to the photoconductive drum 14 and the charged roller 15, the drum cartridge 6 includes a drum frame 21, guided portions 22A, 22B, protrusions 25A, 25B, and a handle 23. The photoconductive drum 14 is located inside the housing 2 in the state in which the drum cartridge 6 and the developing cartridge 8 are mounted on the drawer 5, and the drawer 5 is located at the outside position (see FIG. 2).

3.1. Drum Frame 21

Figure 6A:
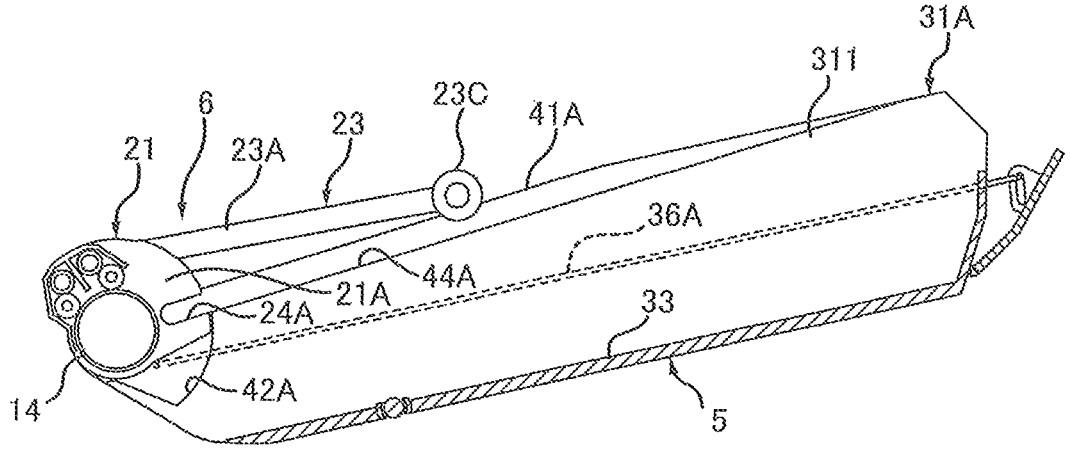
FIG. 6A is a view illustrating a state in which the drum cartridge is mounted on the drawer, and a developing-roller guide is located at a first position.
Figure 6B:
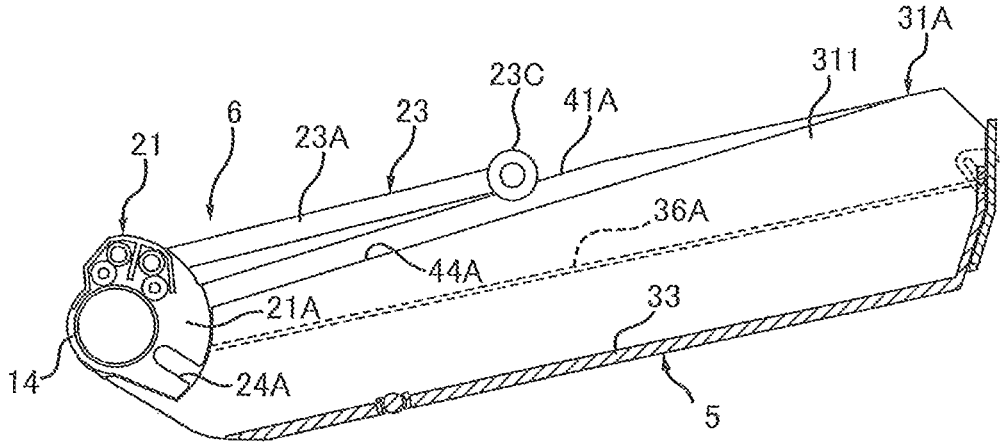
FIG. 6B is a view illustrating a state in which the drum cartridge is mounted on the drawer, and the developing-roller guide is located at a second position.

The drum frame 21 extends in the axial direction. The drum frame 21 has: a first end portion in the axial direction; and a second end portion located apart from the first end portion in the axial direction. The drum frame 21 accommodates the photoconductive drum 14 and the charged roller 15. The drum frame 21 supports the photoconductive drum 14 and the charged roller 15. As illustrated in FIGS. 6A and 6B, the drum frame 21 is rotatable with respect to the drawer 5 in the state in which the drum cartridge 6 is mounted on the drawer 5. As illustrated in FIG. 4, the drum frame 21 includes side plates 21A, 21B.

3.1.1. Side Plate 21A

Figure 5A:
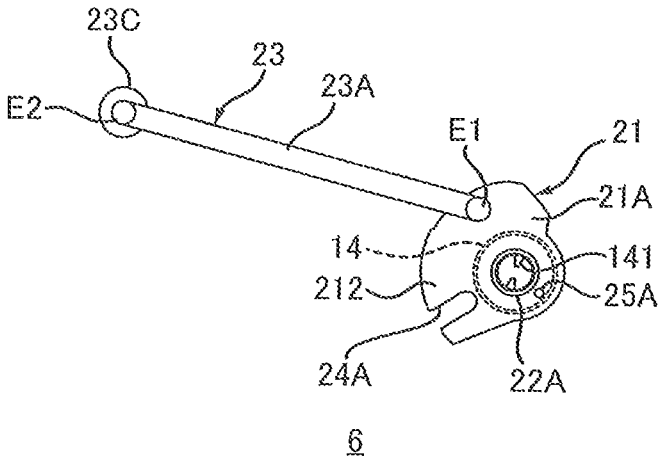
FIG. 5A is a side view of the drum cartridge viewed from one of opposite sides.
Figure 5B:
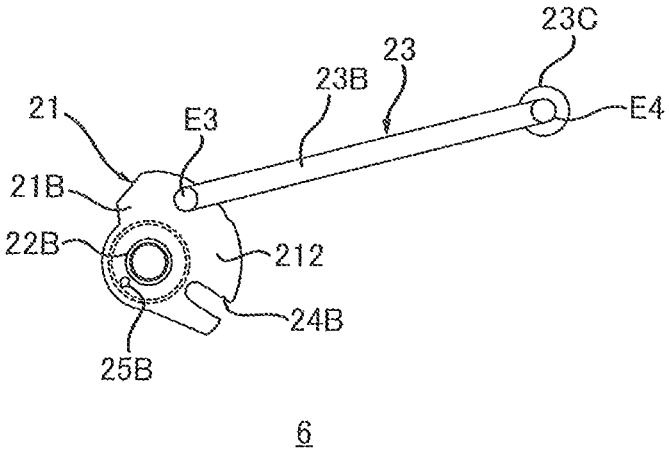
FIG. 5B is a side view of the drum cartridge viewed from the other of the opposite sides.

The side plate 21A is located at the first end portion of the drum frame 21. The side plate 21A extends in a direction intersecting the axial direction. The side plate 21A preferably extends in a direction orthogonal to the axial direction. The side plate 21A has a first surface 211 and a second surface 212. The first surface 211 is located between the second surface 212 and the side plate 21B in the axial direction. As illustrated in FIG. 5A, the side plate 21A includes the developing-roller guide 24A. In other words, the drum frame 21 includes the developing-roller guide 24A. In other words, the drum cartridge 6 includes the developing-roller guide 24A. The developing-roller guide 24A extends toward the photoconductive drum 14. Specifically, the developing-roller guide 24A is a groove.

As illustrated in FIGS. 6A and 6B, the developing-roller guide 24A is pivotable between a first position (see FIG. 6A) and a second position (see FIG. 6B) in the state in which the drum cartridge 6 is mounted on the drawer 5. Specifically, the developing-roller guide 24A pivots by rotation of the drum frame 21 with respect to the drawer 5 in the state in which the drum cartridge 6 is mounted on the drawer 5. The developing-roller guide 24A is connected to a developing-roller guide 44A of the drawer 5 in a state in which the drum cartridge 6 is mounted on the drawer 5, and the developing-roller guide 24A is located at the first position. The developing-roller guide 44A will be described later in detail.

Figure 7A:
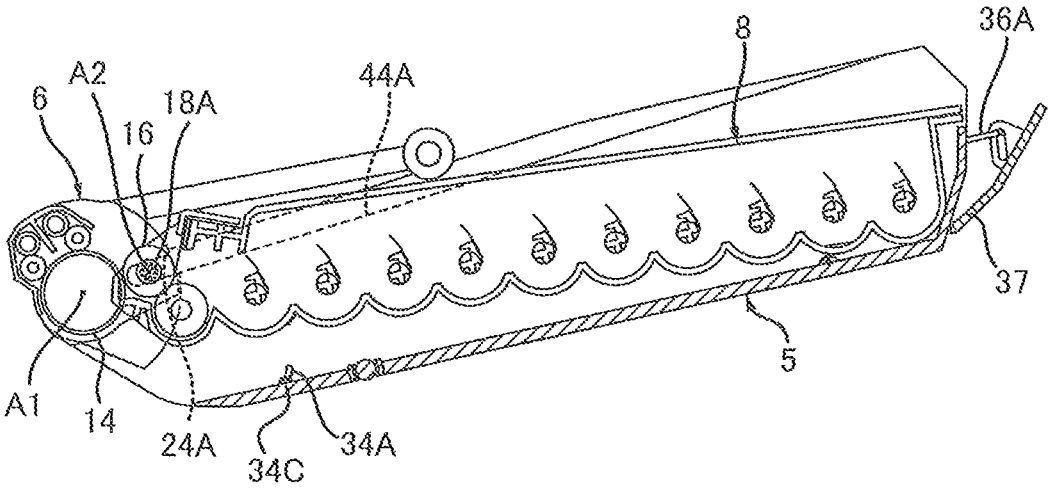
FIG. 7A is a view illustrating a state in which the drum cartridge and the developing cartridge are mounted on the drawer, and the developing-roller guide is located at the first position.

As illustrated in FIG. 7A, in the case where the developing-roller guide 24A is located at the first position in the state in which the drum cartridge 6 is mounted on the drawer 5, when the developing cartridge 8 is mounted on the drawer 5, the guided portion 18A of the developing cartridge 8 is guided by the developing-roller guide 44A. That is, the developing-roller guide 44A guides the developing roller 16 when the developing cartridge 8 is mounted on the drawer 5. The guided portion 18A of the developing cartridge 8 is thereafter fitted to the developing-roller guide 24A. In other words, it is possible to consider that the guided portion 18A that is a portion of the developing cartridge 8 is an inserted portion to be inserted in the developing-roller guide 24A as a recess. The developing-roller guide 24A located at the first position allows the guided portion 18A guided by the developing-roller guide 44A to be inserted into the developing-roller guide 24A as a recess. With this configuration, in the case where the developing-roller guide 24A is located at the first position, when the developing cartridge is mounted on the drawer 5 in the state in which the drum cartridge 6 is mounted on the drawer 5, the developing-roller guide 24A guides the developing roller 16.

Figure 7B:
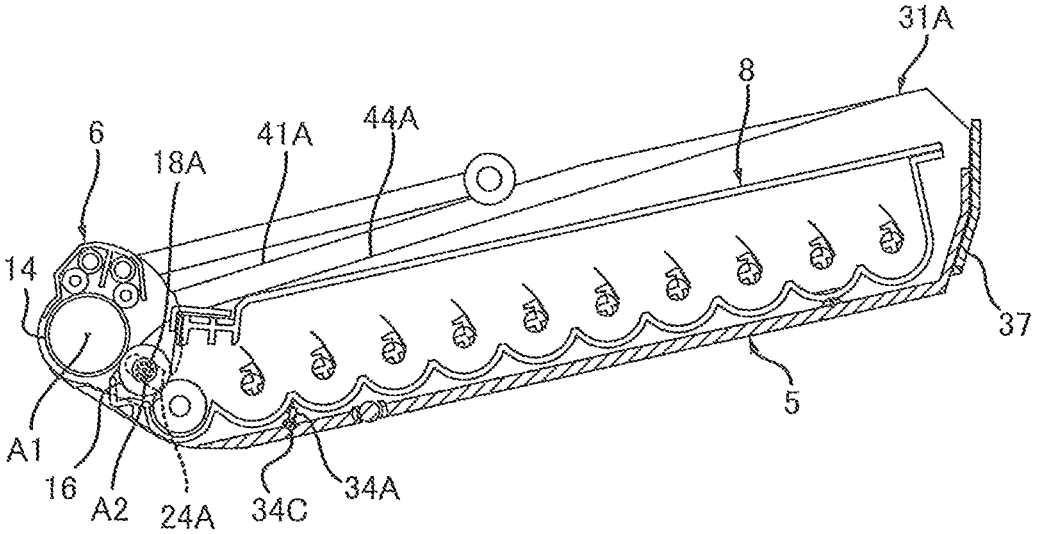
FIG. 7B is a view illustrating a state in which the drum cartridge and the developing cartridge are mounted on the drawer, and the developing-roller guide is located at the second position.

As illustrated in FIG. 7B, in the case where the developing-roller guide 24A is located at the second position in the state in which the drum cartridge 6 and the developing cartridge 8 are mounted on the drawer 5, the developing-roller guide 24A guides the developing roller 16. The second axis A2 of the developing roller 16 is located below the first axis A1 of the photoconductive drum 14 in the state in which the drum cartridge 6 and the developing cartridge 8 are mounted on the drawer 5, and the developing-roller guide 24A is located at the second position. That is, the developing-roller guide 24A pivots from the first position to the second position such that the position of the developing roller 16 when the developing-roller guide 24A is located at the second position is located below the position of the developing roller 16 when the developing-roller guide 24A is located at the first position.

The developing-roller guide 24A is not connected to the developing-roller guide 44A in the state in which the drum cartridge 6 and the developing cartridge 8 are mounted on the drawer 5, and the developing-roller guide 24A is located at the second position. In other words, the developing-roller guide 24A located at the second position does not allow separation of the guided portion 18A inserted in the developing-roller guide 24A as a recess, from the developing-roller guide 24A to the developing-roller guide 44A. In other words, the second position of the developing-roller guide 24A is different from the first position at which the developing-roller guide 24A allows separation of the guided portion 18A inserted in the developing-roller guide 24A as a recess, from the developing-roller guide 24A to the developing-roller guide 44A. Thus, separation of the developing cartridge 8 from the drawer 5 is prevented in the state in which the drum cartridge 6 and the developing cartridge 8 are mounted on the drawer 5, and the developing-roller guide 24A is located at the second position.

3.1.2. Side Plate 21B

As illustrated in FIG. 4, the side plate 21B is located at the second end portion of the drum frame 21. The side plate 21B is located apart from the side plate 21A in the axial direction. The side plate 21B includes the developing-roller guide 24B. The side plate 21B is similar in construction to the side plate 21A, and an explanation of the side plate 21B is dispensed with.

3.2. Guided Portion 22A

As illustrated in FIG. 4, the guided portion 22A is located on an opposite side of the side plate 21A from the side plate 21B in the axial direction. The guided portion 22A extends in the axial direction. The guided portion 22A extends along the first axis A1. The guided portion 22A is located on the second surface 212 of the side plate 21A. The guided portion 22A extends from the second surface 212 of the side plate 21A. The guided portion 22A may be mounted on the second surface 212 of the side plate 21A. The guided portion 22A has a cylindrical shape. The guided portion 22A is fitted to a lock member 35A of the drawer 5 (see FIG. 9) in the state in which the drum cartridge 6 is mounted on the drawer 5. The drum frame 21 is pivotable with respect to the guided portion 22A in a state in which the guided portion 22A is fitted to the lock member 35A.

An end portion of the photoconductive drum 14 in the axial direction is fitted in the guided portion 22A.

Specifically, as illustrated in FIG. 4, the photoconductive drum 14 includes a drum body 51 and flanges 52A, 52B. The drum body 51 extends in the axial direction. The drum body 51 has a cylindrical shape. The drum body 51 has: a first end portion in the axial direction; and a second end portion located apart from the first end portion in the axial direction. The flange 52A is located at the first end portion of the drum body 51. The flange 52A is mounted on the first end portion of the drum body 51. The flange 52A extends in the axial direction. The flange 52A has a cylindrical shape. The flange 52A of the photoconductive drum 14 is fitted in the guided portion 22A.

It is noted that the flange 52A is provided with a drum coupling 141. A body coupling 142 (see FIG. 2) provided in the housing 2 is fitted to the drum coupling 141 in the state in which the drum cartridge 6 is mounted on the drawer 5, and the drawer 5 is located at the inside position. The drum coupling 141 is rotatable with the body coupling 142 in a state in which the body coupling 142 is fitted to the drum coupling 141. With this configuration, the drum coupling 141 rotates the photoconductive drum 14 by receiving power from the body coupling 142.

The flange 52B is located at the second end portion of the drum body 51. The flange 52B is mounted on the second end portion of the drum body 51. The flange 52B extends in the axial direction. The flange 52B has a cylindrical shape.

3.3. Guided Portion 22B

As illustrated in FIG. 4, the guided portion 22B is located on an opposite side of the side plate 21B from the side plate 21A in the axial direction. The guided portion 22B extends in the axial direction. The guided portion 22B extends along the first axis A1. The guided portion 22B is located on the second surface 212 of the side plate 21B. The guided portion 22B extends from the second surface 212 of the side plate 21B. The guided portion 22B may be mounted on the second surface 212 of the side plate 21B. The guided portion 22B has a cylindrical shape. The guided portion 22B is fitted to a lock member 35B of the drawer 5 in the state in which the drum cartridge 6 is mounted on the drawer 5. The drum frame 21 is pivotable with respect to the guided portion 22B in a state in which the guided portion 22B is fitted to the lock member 35B. The guided portion 22B is similar in construction to the guided portion 22A, and an explanation of the guided portion 22B is dispensed with.

3.4. Protrusion 25A

The protrusion 25A is located on an opposite side of the side plate 21A from the side plate 21B in the axial direction. The protrusion 25A extends in the axial direction. The protrusion 25A is located on the second surface 212 of the side plate 21A. The protrusion 25A extends from the second surface 212 of the side plate 21A. The protrusion 25A may be mounted on the second surface 212 of the side plate 21A. The protrusion 25A is located side by side with the guided portion 22A. The protrusion 25A is fitted in a recess 351A of the lock member 35A of the drawer 5 (see FIG. 9) in the state in which the drum cartridge 6 is mounted on the drawer 5. The recess 351A will be described later in detail.

3.5. Protrusion 25B

The protrusion 25B is located on an opposite side of the side plate 21B from the side plate 21A in the axial direction. The protrusion 25B extends in the axial direction. The protrusion 25B is located on the second surface 212 of the side plate 21B. The protrusion 25B extends from the second surface 212 of the side plate 21B. The protrusion 25B may be mounted on the second surface 212 of the side plate 21B. The protrusion 25B is located side by side with the guided portion 22B. The protrusion 25B is fitted in a recess 351B of the lock member 35B of the drawer 5 (see FIG. 8) in the state in which the drum cartridge 6 is mounted on the drawer 5.

3.6. Handle 23

A user holds the handle 23 when replacing the drum cartridge 6. As illustrated in FIG. 4, the handle 23 includes arms 23A, 23B and a grip 23C. As illustrated in FIGS. 6A and 6B, the handle 23 is located above the developing-roller guide 24A in the state in which the drum cartridge 6 is mounted on the drawer 5.

As illustrated in FIG. 4, the arm 23A extends in a direction intersecting the axial direction. The arm 23A includes an end portion E1 and an end portion E2. The end portion E2 is located apart from the end portion E1 in the direction in which the arm 23A extends. The end portion E1 of the arm 23A is mounted on the side plate 21A to allow the arm 23A to pivot.

The arm 23B is located apart from the arm 23A in the axial direction. The arm 23B extends in the direction intersecting the axial direction. The arm 23B includes an end portion E3 and an end portion E4. The end portion E4 is located apart from the end portion E3 in the direction in which the arm 23B extends. The end portion E3 is mounted on the side plate 21B to allow the arm 23B to pivot. Since the arm 23A is pivotably mounted on the side plate 21A, and the arm 23B is pivotably mounted on the side plate 21B, the handle 23 is pivotably supported by the side plate 21A and the side plate 21B.

The grip 23C is located between the end portion E2 of the arm 23A and the end portion E4 of the arm 23B in the axial direction. The grip 23C extends in the axial direction. The grip 23C has a circular cylindrical shape. One end portion of the grip 23C in the axial direction is connected to the end portion E2 of the arm 23A. The other end portion of the grip 23C in the axial direction is connected to the end portion E4 of the arm 23B.

4. Details of Drawer 5

There will be next described the drawer 5 in detail with reference to FIGS. 8-10B.

Figure 8:
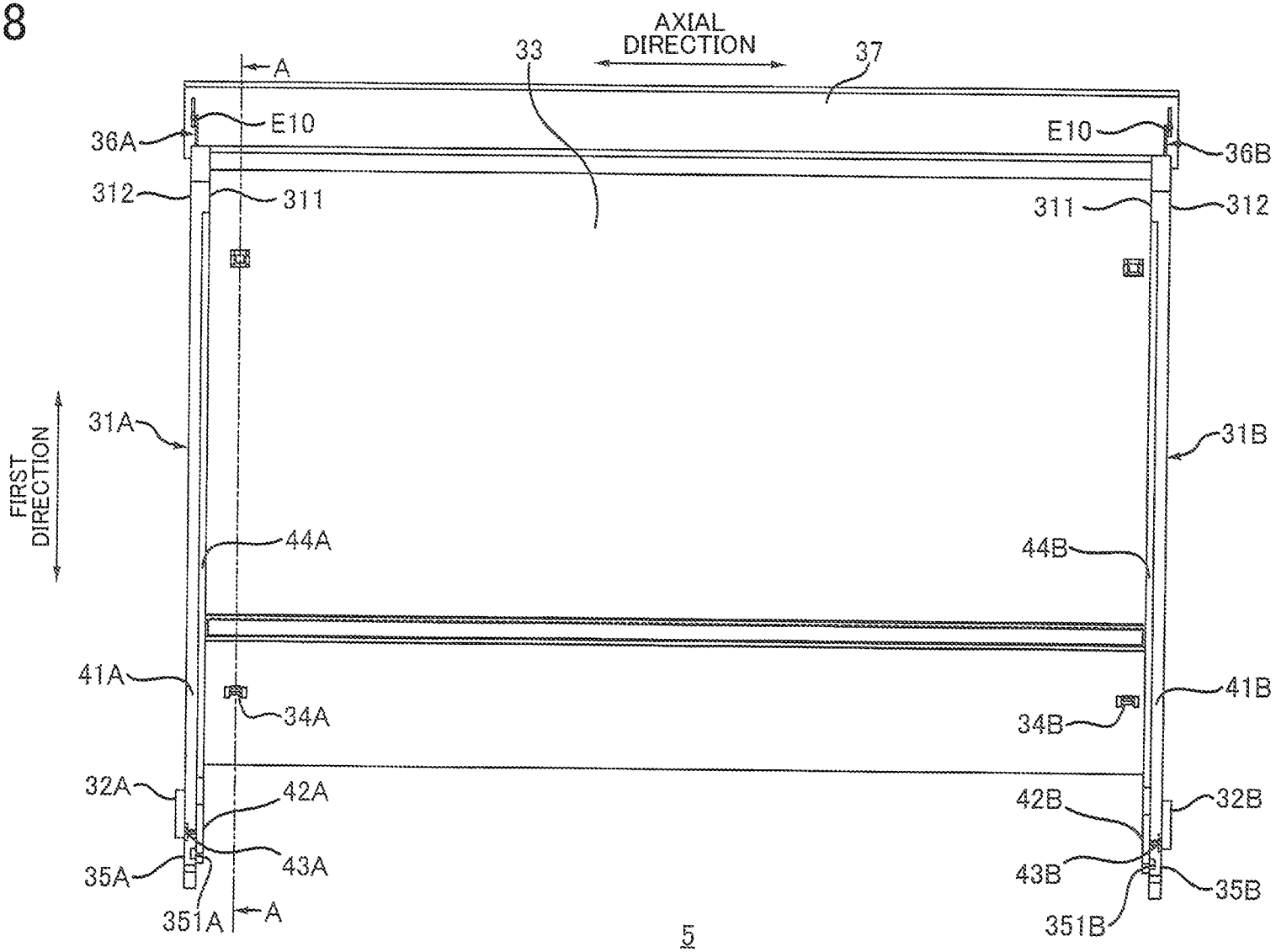
FIG. 8 is a plan view of the drawer.

As illustrated in FIG. 8, the drawer 5 extends in the axial direction. The drawer 5 includes side plates 31A, 31B, the guided portion 32A, a guided portion 32B, a bottom plate 33, pressing members 34A, 34B, the lock members 35A, 35B, linking members 36A, 36B, and a lever 37. That is, the image forming apparatus 1 includes the pressing members 34A, 34B.

4.1. Side Plate 31A

Figure 9:
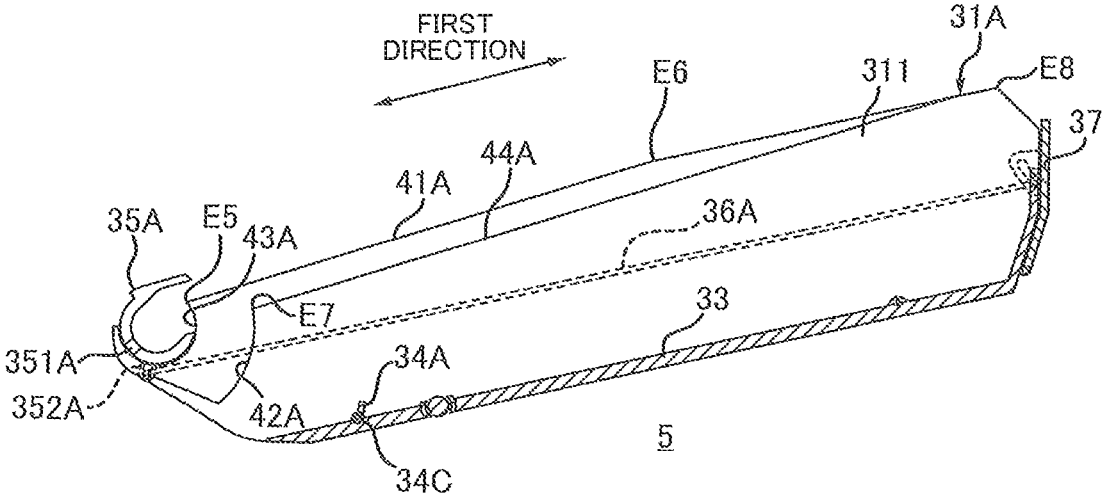
FIG. 9 is a cross-sectional view of the drawer, taken along line A-A in FIG. 8.
Figure 10A:
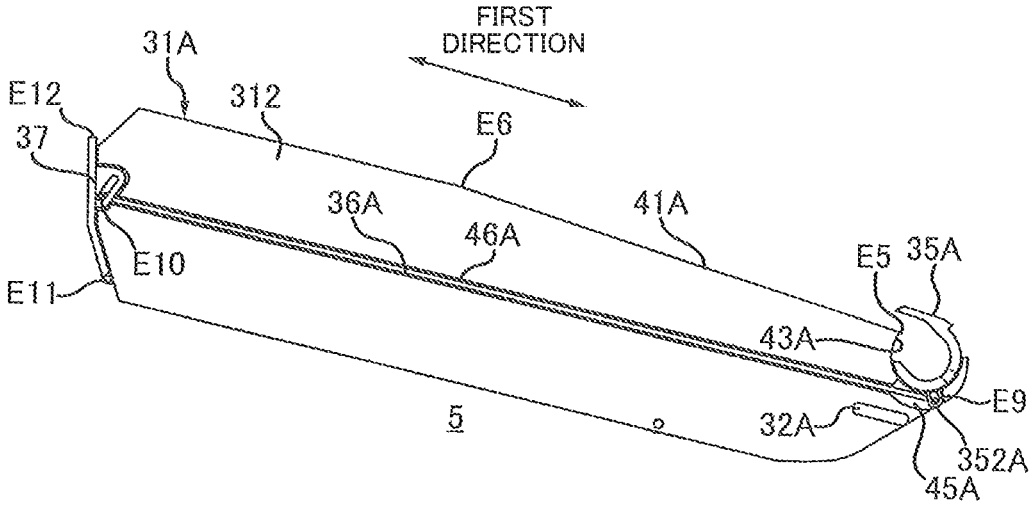
FIG. 10A is a side view of the drawer, illustrating a state in which a lock member is located at a lock position.
Figure 10B:
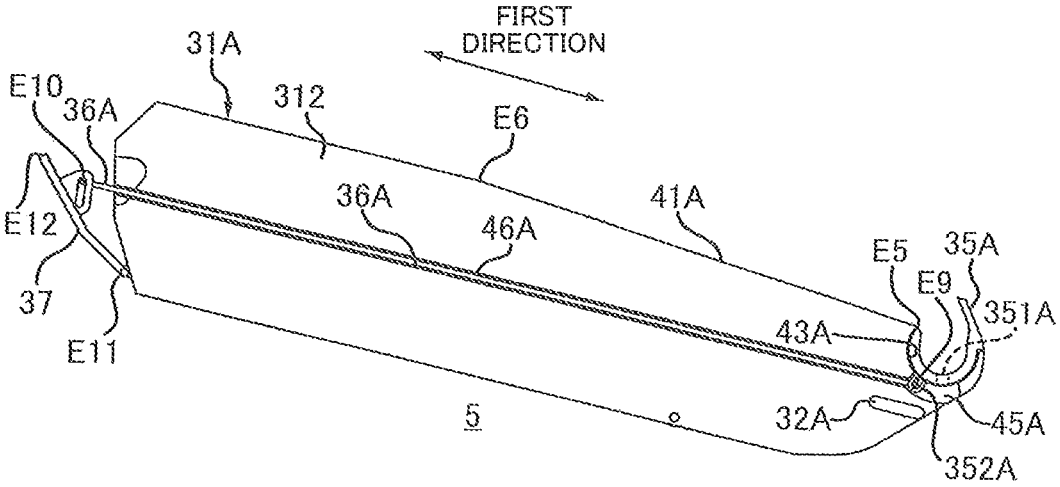
FIG. 10B is a side view of the drawer, illustrating a state in which the lock member is located at a lock release position.

The side plate 31A is located at one end portion of the drawer 5 in the axial direction. The side plate 31A extends in a direction intersecting the axial direction. The side plate 31A has a first surface 311 and a second surface 312. The first surface 311 is located between the second surface 312 and the side plate 31B in the axial direction. The side plate 31A includes a first drum guide 41A, a second drum guide 42A, and the developing-roller guide 44A. That is, the drawer 5 includes the first drum guide 41A, the second drum guide 42A, and the developing-roller guide 44A. As illustrated in FIG. 9, the side plate 31A has a cutout 43A. As illustrated in FIGS. 10A and 10B, the side plate 31A has a recess 45A and a groove 46A.

4.1.1. First Drum Guide 41A

As illustrated in FIG. 9, the first drum guide 41A is located at an edge of the side plate 31A. The first drum guide 41A extends in the first direction. The first drum guide 41A includes an end portion E5 and an end portion E6. The end portion E6 is located apart from the end portion E5 in the first direction. The first drum guide 41A is inclined with respect to the first direction such that the end portion E5 is nearer to the bottom plate 33 than the end portion E6. The first drum guide 41A guides the drum cartridge 6 when the drum cartridge 6 is mounted on the drawer 5. Specifically, when the drum cartridge 6 is mounted on the drawer 5, the first drum guide 41A guides the guided portion 22A (see FIG. 4) of the drum cartridge 6.

4.1.2. Second Drum Guide 42A

As illustrated in FIG. 8, the second drum guide 42A is located between the first drum guide 41A and the side plate 31B in the axial direction. The second drum guide 42A is provided on the first surface 311 of the side plate 31A. The second drum guide 42A receives the side plate 21A (see FIG. 6A) of the drum frame 21 of the drum cartridge 6 in the state in which the drum cartridge 6 is mounted on the drawer 5.

4.1.3. Cutout 43A

As illustrated in FIG. 9, the cutout 43A is located at one end portion of the side plate 31A in the first direction. The cutout 43A is connected to the end portion E5 of the first drum guide 41A. In other words, the cutout 43A is connected to the first drum guide 41A. In this embodiment, the cutout 43A has an arc shape. The lock member 35A is fitted in the cutout 43A of the side plate 31A.

4.1.4. Developing-Roller Guide 44A

As illustrated in FIG. 9, the developing-roller guide 44A extends in the first direction on the first surface 311 of the side plate 31A. The developing-roller guide 44A includes an end portion E7 and an end portion E8. The end portion E8 is located apart from the end portion E7 in the first direction. The end portion E7 continues to the second drum guide 42A. In other words, the developing-roller guide 44A is connected to the second drum guide 42A. The developing-roller guide 44A is inclined with respect to the first direction such that the end portion E7 is nearer to the bottom plate 33 than the end portion E8. As illustrated in FIG. 2, the developing-roller guide 24A is located inside the housing 2, and at least a portion of the developing-roller guide 44A is located outside the housing 2 in the state in which the drum cartridge 6 is mounted on the drawer 5, and the drawer 5 is located at the outside position.

4.1.5. Recess 45A

As illustrated in FIGS. 10A and 10B, the recess 45A is formed in the second surface 312 of the side plate 31A. The recess 45A receives a coupling portion 352A of the lock member 35A. The coupling portion 352A will be described later in detail.

4.1.6. Groove 46A

The groove 46A is formed in the second surface 312 of the side plate 31A. The groove 46A extends in the first direction. The groove 46A continues to the recess 45A. The linking member 36A extends in the groove 46A. The groove 46A guides the linking member 36A. The linking member 36A will be described later in detail.

4.2. Side Plate 31B

As illustrated in FIG. 8, the side plate 31B is located at the other end portion of the drawer 5 in the axial direction. The side plate 31B is located apart from the side plate 31A in the axial direction. The side plate 31B extends in a direction intersecting the axial direction. The side plate 31B includes a first drum guide 41B, a second drum guide 42B, a cutout 43B, a developing-roller guide 44B, a recess having the same construction as that of the recess 45A, and a groove having the same construction as that of the groove 46A. The side plate 31B is similar in construction to the side plate 31A, and an explanation of the side plate 31B is dispensed with.

4.3. Guided Portion 32A

As illustrated in FIG. 8, the guided portion 32A is located on an opposite side of the side plate 31A from the side plate 31B in the axial direction. The guided portion 32A extends in the axial direction. The guided portion 32A is located on the second surface 312 of the side plate 31A. The guided portion 32A extends from the second surface 312 of the side plate 31A. The guided portion 32A may be mounted on the second surface 312 of the side plate 31A. The guided portion 32A is a rib. The guided portion 32A extends in the first direction. The guided portion 32A is guided by the body guide 100 (see FIG. 2).

4.4. Guided Portion 32B

The guided portion 32B is located on an opposite side of the side plate 31B from the side plate 31A in the axial direction. The guided portion 32B extends in the axial direction. The guided portion 32B is located on the second surface 312 of the side plate 31B. The guided portion 32B extends from the second surface 312 of the side plate 31B. The guided portion 32B may be mounted on the second surface 312 of the side plate 31B. The guided portion 32B is a rib. The guided portion 32B extends in the first direction. The guided portion 32B is guided by the body guide 100.

4.5. Bottom Plate 33

As illustrated in FIG. 8, the bottom plate 33 is located between the side plate 31A and the side plate 31B in the axial direction. The bottom plate 33 extends in the axial direction. One end of the bottom plate 33 in the axial direction is connected to the side plate 31A. The other end of the bottom plate 33 in the axial direction is connected to the side plate 31B.

4.6. Pressing Member 34A

As illustrated in FIGS. 8 and 9, the pressing member 34A is mounted on the bottom plate 33. It is noted that the pressing member 34A may be mounted on the side plate 31A. As illustrated in FIG. 7B, the pressing member 34A presses the developing cartridge 8 to bring the developing roller 16 into contact with the photoconductive drum 14 in the state in which the drum cartridge 6 and the developing cartridge 8 are mounted on the drawer 5, and the developing-roller guide 24A is located at the second position. The pressing member 34A presses the developing cartridge 8 so as to press the developing roller 16 against the photoconductive drum 14. Specifically, the drawer 5 includes a spring 34C. The spring 34C causes the pressing member 34A to press the developing cartridge 8. That is, the pressing member 34A presses the developing cartridge 8 such that the elastic force of the spring 34C causes the developing roller 16 to be pressed against the photoconductive drum 14.

4.7. Pressing Member 34B

As illustrated in FIG. 8, the pressing member 34B is located apart from the pressing member 34A in the axial direction. The pressing member 34B is similar in construction to the pressing member 34A, and an explanation of the pressing member 34B is dispensed with.

4.8. Lock Member 35A

As illustrated in FIG. 9, the lock member 35A is fitted in the cutout 43A of the side plate 31A. The lock member 35A is supported by the cutout 43A. The lock member 35A is pivotable between a lock position (see FIG. 10A) and a lock release position (see FIG. 10B).

Figure 11A:
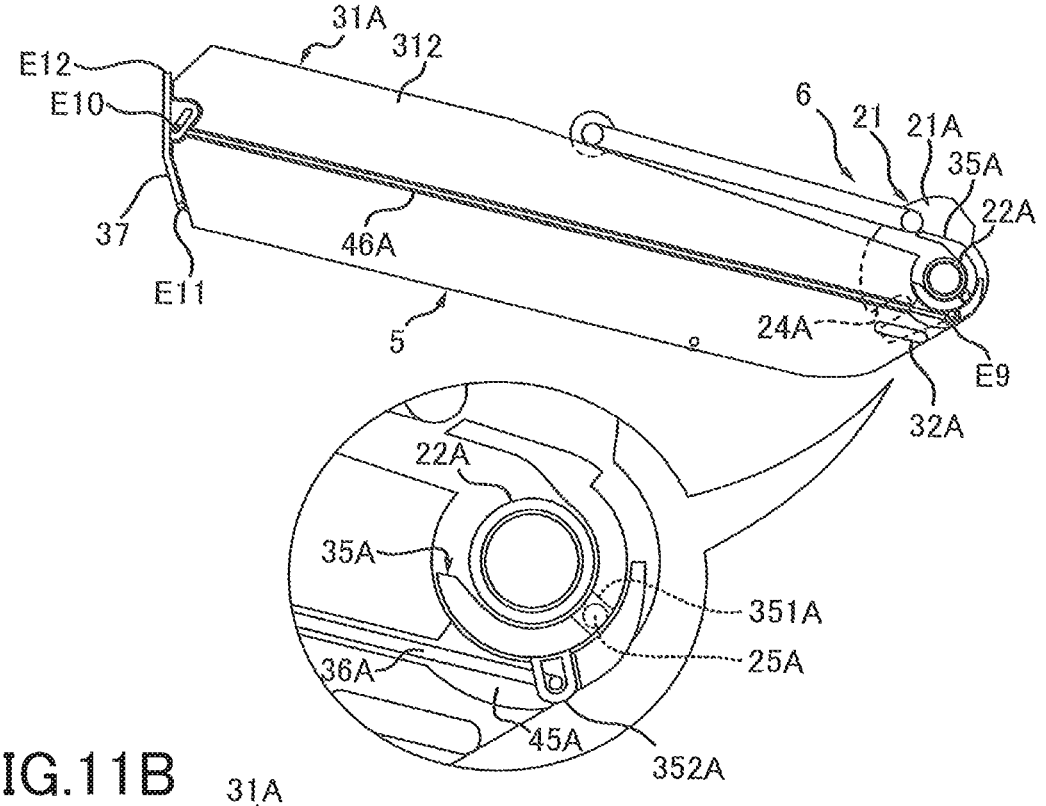
FIG. 11A is a view illustrating a state in which the drum cartridge is mounted on the drawer, and the lock member is located at the lock position.

As illustrated in FIG. 11A, when the lock member 35A is located at the lock position in the state in which the drum cartridge 6 is mounted on the drawer 5, the lock member 35A locks the drum cartridge 6 to the drawer 5. When the lock member 35A is located at the lock position in the state in which the drum cartridge 6 is mounted on the drawer 5, separation of the drum cartridge 6 from the drawer 5 is not allowed. When the lock member 35A is located at the lock position in the state in which the drum cartridge 6 is mounted on the drawer 5, the developing-roller guide 24A is located at the second position.

Figure 11B:
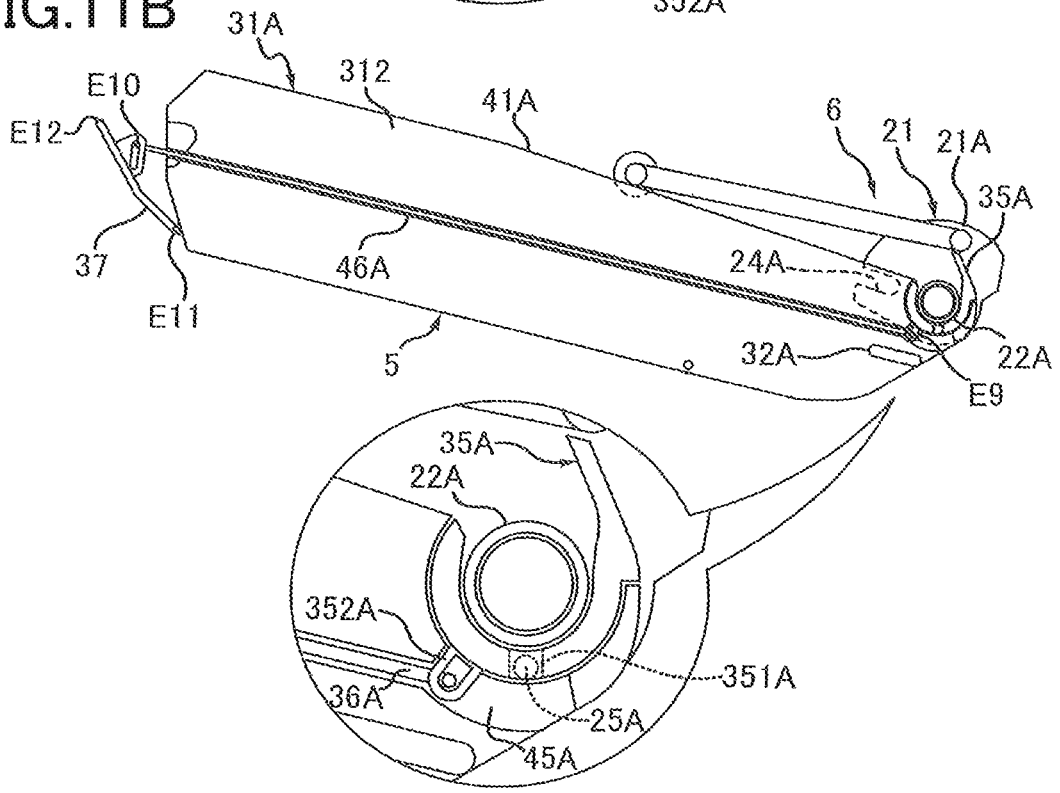
FIG. 11B is a view illustrating a state in which the drum cartridge is mounted on the drawer, and the lock member is located at the lock release position.

As illustrated in FIG. 11B, when the lock member 35A is located at the lock release position in the state in which the drum cartridge 6 is mounted on the drawer 5, the lock member 35A releases the lock of the drum cartridge 6 to the drawer 5. When the lock member 35A is located at the lock release position in the state in which the drum cartridge 6 is mounted on the drawer 5, separation of the drum cartridge 6 from the drawer 5 is allowed. When the lock member 35A is located at the lock release position in the state in which the drum cartridge 6 is mounted on the drawer 5, the developing-roller guide 24A is located at the first position.

Here, as illustrated in FIG. 2, the housing 2 has a contact surface 46. In other words, the image forming apparatus 1 has the contact surface 46. The contact surface 46 is in contact with an end portion of the photoconductive drum 14 of the drum cartridge 6 in the state in which the drum cartridge 6 is mounted on the drawer 5, and the drawer 5 is located at the outside position. The contact surface 46 serves as a stopper that contacts the drum cartridge 6 to prevent separation of the drum cartridge 6 from the drawer 5 when the developing cartridge 8 is removed from the drawer 5 on which the drum cartridge 6 and the developing cartridge 8 are mounted. Specifically, the drum cartridge 6 is not locked to the drawer 5 when the lock member 35A (see FIG. 7A) is located at the lock release position in the state in which the drum cartridge 6 and the developing cartridge 8 are mounted on the drawer 5, and the drawer 5 is located at the outside position. The contact surface 46 serves as a stopper that contacts the drum cartridge 6 to prevent the drum cartridge 6 from being separated from the drawer 5 by following the developing cartridge 8 when the developing cartridge 8 is removed from the drawer 5. The contact surface 46 extends in a direction intersecting a moving direction of the drawer 5. The contact surface 46 preferably extends in a direction orthogonal to the moving direction of the drawer 5.

As illustrated in FIG. 10B, the lock member 35A includes the recess 351A and the coupling portion 352A.

4.8.1. Recess 351A

As illustrated in FIGS. 11A and 11B, the protrusion 25A of the drum frame 21 of the drum cartridge 6 is fitted in the recess 351A in the state in which the drum cartridge 6 is mounted on the drawer 5. Thus, the lock member 35A is pivotable with the drum frame 21 of the drum cartridge 6 in the state in which the drum cartridge 6 is mounted on the drawer 5. That is, the lock member 35A is pivotable between the lock position and the lock release position with the developing-roller guide 24A in the state in which the drum cartridge 6 is mounted on the drawer 5.

4.8.2. Coupling Portion 352A

As illustrated in FIGS. 10A and 10B, the coupling portion 352A is received by the recess 45A of the side plate 31A. The coupling portion 352A is movable in the recess 45A. One end portion of the linking member 36A is coupled to the coupling portion 352A. The linking member 36A will be described later in detail.

4.9. Lock Member 35B

The lock member 35B is fitted in the cutout 43B of the side plate 31B. The lock member 35B includes the recess 351B (see FIG. 8) and a coupling portion having the same construction as that of the coupling portion 352A. The lock member 35B is similar in construction to the lock member 35A, and an explanation of the lock member 35B is dispensed with.

4.10. Linking Member 36A

As illustrated in FIGS. 10A and 10B, the linking member 36A connects the lock member 35A and the lever 37 to each other. As illustrated in FIG. 8, the linking member 36A extends in a direction intersecting the axial direction. The linking member 36A preferably extends in a direction orthogonal to the axial direction. The linking member 36A includes an end portion E9 and an end portion E10. The end portion E10 is located apart from the end portion E9 in the first direction. The end portion E9 is connected to the coupling portion 352A of the lock member 35A. In other words, the end portion E9 is connected to the lock member 35A. The end portion E10 is connected to the lever 37. The linking member 36A is located in the groove 46A of the side plate 31A. The linking member 36A is movable along the groove 46A.

4.11. Linking Member 36B

The linking member 36B connects the lock member 35B and the lever 37 to each other. The linking member 36B extends in a direction intersecting the axial direction. The linking member 36B preferably extends in a direction orthogonal to the axial direction. The linking member 36B is similar in construction to the linking member 36A, and an explanation of the linking member 36B is dispensed with.

4.12. Lever 37

The lever 37 causes the lock members 35A, 35B to pivot from the respective lock positions to the respective lock release positions. As illustrated in FIG. 2, the lever 37 is located outside the housing 2 in the state in which the drawer 5 is located at the outside position.

The lever 37 is pivotable between a lever first position (see FIG. 11A) and a lever second position (see FIG. 11B). When the lever 37 is moved from the lever first position to the lever second position, the linking member 36A causes the lock member 35A to pivot from the lock position to the lock release position. Also, the linking member 36B causes the lock member 35B to pivot from the lock position to the lock release position. When the lever 37 is moved from the lever second position to the lever first position, the linking member 36A causes the lock member 35A to pivot from the lock release position to the lock position. Also, the linking member 36B causes the lock member 35B to pivot from the lock release position to the lock position.

As illustrated in FIG. 8, the lever 37 extends in the axial direction. As illustrated in FIGS. 11A and 11B, the lever 37 includes an end portion E11 and an end portion E12. The end portion E11 is located below the end portion E12. The end portion E11 is connected to the side plate 31A. The end portion E10 of the linking member 36A is connected to the lever 37 at a position between the end portion E11 of the lever 37 and the end portion E12 of the lever 37. The end portion E10 of the linking member 36B is connected to the lever 37 at a position between the end portion E11 of the lever 37 and the end portion E12 of the lever 37.

5. Mounting of Drum Cartridge 6

There will be next described mounting of the drum cartridge 6 to the drawer 5 with reference to FIGS. 4, 8, 10B, FIG. 11B, and FIG. 12.

When mounting the drum cartridge 6 to the drawer 5, the user first positions the cover 3 at the open position and draws the drawer 5 from the housing 2.

The user then puts the drum cartridge 6 on the drawer 5 in a state in which the drawer 5 is located at the outside position, and the lock member 35A is located at the lock release position (see FIG. 10B).

In response, the side plate 21A (see FIG. 4) of the drum cartridge 6 is brought into contact with the developing-roller guide 44A (see FIG. 8) of the drawer 5, and the guided portion 22A (see FIG. 4) of the drum cartridge 6 is brought into contact with the first drum guide 41A (see FIG. 8) of the side plate 31A of the drawer 5.

The user then slides the drum cartridge 6 toward the inside of the housing 2.

In response, the side plate 21A of the drum cartridge 6 is guided by the developing-roller guide 44A, and the guided portion 22A of the drum cartridge 6 is guided by the first drum guide 41A. The drum cartridge 6 is slid toward the inside of the housing 2.

Figure 12:
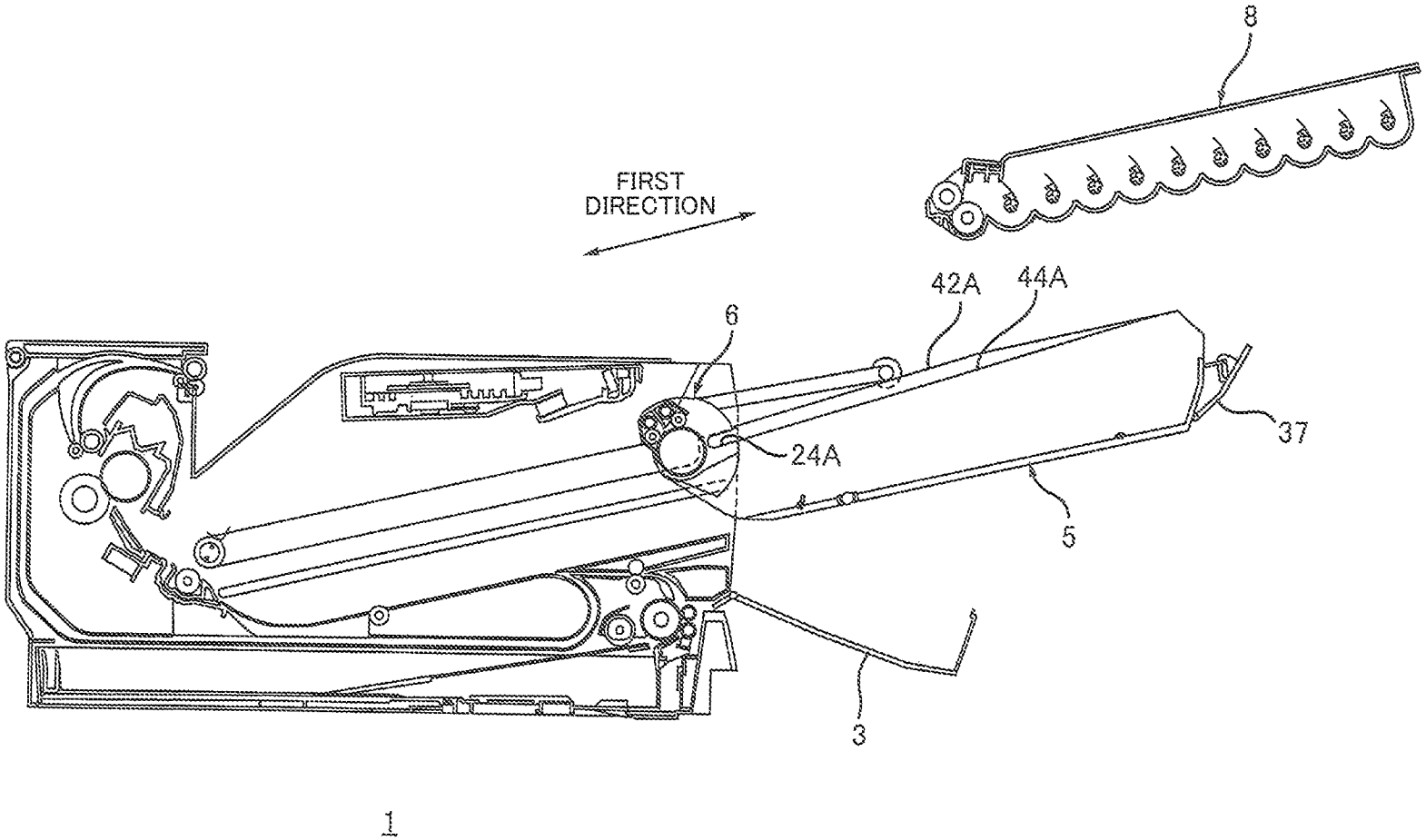
FIG. 12 is a view illustrating a state in which the developing cartridge is removed from the image forming apparatus.

When the drum cartridge 6 is fitted to the lock member 35A of the drawer 5 (see FIG. 11B), and the protrusion 25A of the drum cartridge 6 is fitted in the recess 351A (see FIG. 11B), mounting of the drum cartridge 6 to the drawer 5 is completed. As illustrated in FIG. 12, the developing-roller guide 24A of the drum cartridge 6 is connected to the developing-roller guide 44A of the drawer 5 in the state in which the drum cartridge 6 is mounted on the drawer 5.

It is noted that, when removing the drum cartridge 6 from the drawer 5, the user removes the drum cartridge 6 from the drawer 5 in the first direction in a state in which the drawer 5 is located at the outside position, and the lock member 35A is located at the lock release position.

In response, the protrusion 25A is detached from the recess 351A, and the guided portion 22A is detached from the lock member 35A, so that the drum cartridge 6 is removed from the drawer 5.

6. Mounting of Developing Cartridge 8

There will be next described mounting of the developing cartridge 8 to the drawer 5 with reference to FIGS. 2, 3, 6A-8, 12, and 13.

When mounting the developing cartridge 8 to the drawer 5, the user puts the developing cartridge 8 on the drawer 5 in a state in which the drawer 5 is located at the outside position, and the drum cartridge 6 is mounted on the drawer 5 (see FIG. 12).

In response, the guided portion 18A (see FIG. 3) of the developing cartridge 8 is brought into contact with the developing-roller guide 44A (see FIG. 8) of the drawer 5.

The user then slides the developing cartridge 8 toward the inside of the housing 2.

In response, the guided portion 18A of the developing cartridge 8 is guided by the developing-roller guide 44A of the drawer 5 and thereafter guided by the developing-roller guide 24A of the drum cartridge 6, whereby the developing cartridge 8 is slid toward the inside of the housing 2.

As illustrated in FIG. 7A, the guided portion 18A of the developing cartridge 8 is fitted to the developing-roller guide 24A of the drum cartridge 6.

The user then moves the lever 37 of the drawer 5 from the lever second position (see FIG. 13) to the lever first position (see FIG. 2).

In response, as illustrated in FIGS. 6A and 6B, the drum frame 21 of the drum cartridge 6 pivots to move the developing-roller guide 24A from the first position to the second position. When the developing-roller guide 24A is positioned at the second position, the second axis A2 of the developing roller 16 is located below the first axis A1 of the photoconductive drum 14. As a result, mounting of the developing cartridge 8 to the drawer 5 is completed.

It is noted that, when removing the developing cartridge 8 from the drawer 5, the user moves the lever 37 from the lever first position to the lever second position in the state in which the drawer 5 is located at the outside position.

This operation moves the developing-roller guide 24A from the second position to the first position.

The user then removes the developing cartridge 8 from the drawer 5 in the first direction.

In response, as illustrated in FIG. 12, the developing cartridge 8 is removed from the drawer 5.

Figure 13:
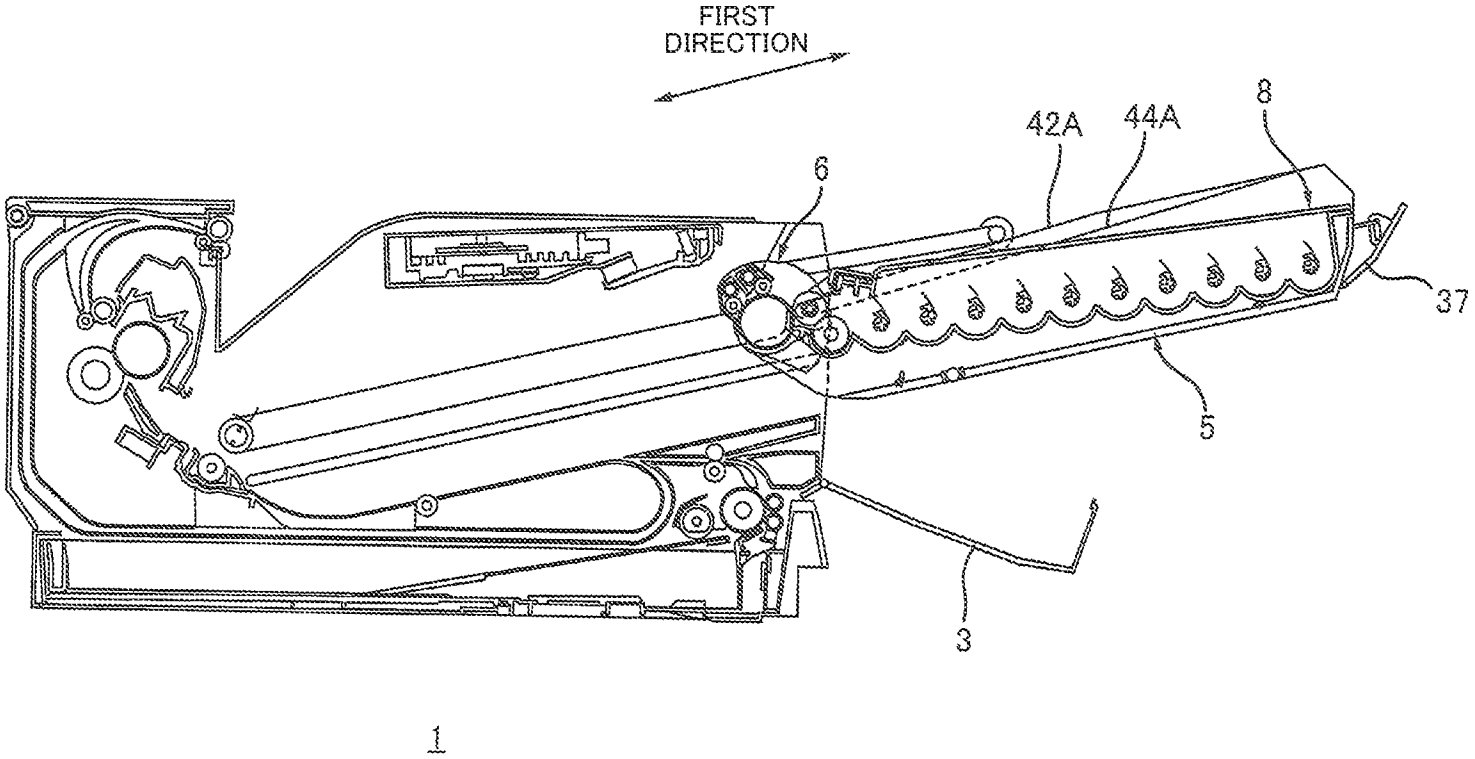
FIG. 13 is a view illustrating a state in which the developing cartridge is mounted on the drawer, and the developing-roller guide is located at the first position in the image forming apparatus illustrated in FIG. 12.

7. Effects (1) In the image forming apparatus 1, as illustrated in FIGS. 12 and 13, the developing cartridge 8 is mounted on the drawer 5 in the state in which the drum cartridge 6 is mounted on the drawer 5, the drawer 5 is located at the outside position, and the developing-roller guide 24A is located at the first position. In this operation, as illustrated in FIG. 7A, the developing roller 16 is guided by the developing-roller guide 24A of the drum cartridge 6 mounted on the drawer 5.

When the developing-roller guide 24A thereafter pivots from the first position to the second position, as illustrated in FIG. 7B, the developing roller 16 is moved downward with the pivotal movement of the developing-roller guide 24A.

When the developing-roller guide 24A is positioned at the second position, the second axis A2 of the developing roller 16 is located below the first axis A1 of the photoconductive drum 14.

Thus, it is possible for the user to replace the developing cartridge 8 including the developing roller 16, in the state in which the drum cartridge 6 including the photoconductive drum 14 is mounted on the drawer 5.

Specifically, even in the case where the second axis A2 of the developing roller 16 is located below the first axis A1 of the photoconductive drum 14, the developing cartridge 8 including the developing roller 16 can be replaced without removing the drum cartridge 6 from the drawer 5.

The configuration in which the second axis A2 of the developing roller 16 is located below the first axis A1 of the photoconductive drum 14 easily prevents leakage of the toner from the developing cartridge 8.

(2) In the image forming apparatus 1, as illustrated in FIG. 7A, the drawer 5 includes the developing-roller guide 44A. When the developing cartridge 8 is mounted on the drawer 5, the developing-roller guide 44A guides the developing roller 16.

As illustrated in FIG. 7A, the developing-roller guide 44A is connected to the developing-roller guide 24A in the state in which the drum cartridge 6 is mounted on the drawer 5, and the developing-roller guide 24A is located at the first position. As illustrated in FIG. 7B, the developing-roller guide 44A is not connected to the developing-roller guide 24A in the state in which the drum cartridge 6 is mounted on the drawer 5, and the developing-roller guide 24A is located at the second position.

Thus, as illustrated in FIG. 7B, the developing-roller guide 24A and the developing-roller guide 44A are not connected to each other in the state in which the drum cartridge 6 and the developing cartridge 8 are mounted on the drawer 5, and the developing-roller guide 24A is located at the second position.

This configuration prevents separation of the developing cartridge 8 from the drawer 5.

In the image forming apparatus 1, as illustrated in FIG. 2, the developing-roller guide 24A is located inside the housing 2, and at least a portion of the developing-roller guide 44A is located outside the housing in the state in which the drum cartridge 6 is mounted on the drawer 5, and the drawer 5 is located at the outside position.

This configuration allows the user to mount the developing cartridge 8 to the drawer 5 with high operability.

Specifically, when the user mounts the developing cartridge 8 to the drawer 5 in the state in which the drum cartridge 6 is mounted on the drawer 5, and the drawer 5 is located at the outside position, the user easily mounts the developing cartridge 8 to the drawer 5, targeting the developing-roller guide 44A, at least a portion of which is located outside the housing 2.

The user can thereafter slide the developing cartridge 8 along the developing-roller guide 44A to fit the developing cartridge 8 to the developing-roller guide 24A.

(4) In the image forming apparatus 1, as illustrated in FIGS. 10A and 10B, the drawer 5 includes the linking member 36A connecting the lock member 35A and the lever 37 to each other.

This configuration allows the user to operate the lever 37 to move the lock member 35A, at a position distant from the lock member 35A.

As a result, in the case where the cover 3 is located at the open position, and the drawer 5 is located at the inside position, the user can operate the lever 37 to move the lock member 35A via the linking member 36A.

(5) In the image forming apparatus 1, as illustrated in FIG. 2, the housing 2 has the contact surface 46 extending in the direction intersecting the moving direction of the drawer 5. The contact surface 46 is in contact with the end portion of the photoconductive drum 14 in the state in which the drum cartridge 6 is mounted on the drawer 5, and the drawer 5 is located at the outside position.

Thus, when the developing cartridge 8 is removed from the drawer 5 in the state in which the drum cartridge 6 is mounted on the drawer 5, it is possible to keep the state in which the drum cartridge 6 is mounted on the drawer 5.

Specifically, there is a possibility that the drum cartridge 6 follows the developing cartridge 8 when the developing cartridge 8 is removed from the drawer 5 in the state in which the drawer 5 supporting the drum cartridge 6 and the developing cartridge 8 is located at the outside position.

In the image forming apparatus 1, however, even if the drum cartridge 6 follows the developing cartridge 8, the photoconductive drum 14 of the drum cartridge 6 contacts the contact surface 46 to prevent separation of the drum cartridge 6 from the drawer 5.

This prevents the drum cartridge 6 from becoming detached with the developing cartridge 8 when the developing cartridge 8 is removed from the drawer 5 in the state in which the drum cartridge 6 is mounted on the drawer 5.

(6) In the image forming apparatus 1, as illustrated in FIG. 2, the photoconductive drum 14 is located inside the housing 2 in the state in which the drum cartridge 6 and the developing cartridge 8 are mounted on the drawer 5, and the drawer 5 is located at the outside position.

This configuration enables the housing 2 to protect the photoconductive drum 14 in the state in which the drawer 5 is located at the outside position.

(7) In the image forming apparatus 1, as illustrated in FIG. 5A, the drum cartridge 6 includes the drum frame 21 including the developing-roller guide 24A. The developing-roller guide 24A is pivotable between the first position and the second position by rotation of the drum frame 21 with respect to the drawer 5 in the state in which the drum cartridge 6 is mounted on the drawer 5.

This enables the developing-roller guide 24A to pivot using the drum frame 21.

(8) As illustrated in FIGS. 7A and 7B, the image forming apparatus 1 includes the pressing member 34A. The pressing member 34A presses the developing cartridge 8 to hold the developing roller 16 in contact with the photoconductive drum 14 in the state in which the drum cartridge 6 and the developing cartridge 8 are mounted on the drawer 5, and the developing-roller guide 24A is located at the second position (see FIG. 7B).

This configuration enabels the developing roller 16 to be in appropriate contact with the photoconductive drum 14 in the state in which the drum cartridge 6 and the developing cartridge 8 are mounted on the drawer 5, and the developing-roller guide 24A is located at the second position (see FIG. 7B).

The pressing member 34A is not in contact with the developing cartridge 8 in the state in which the drum cartridge 6 and the developing cartridge 8 are mounted on the drawer 5, and the developing-roller guide 24A is located at the first position (see FIG. 7A).

This enables the developing cartridge 8 to be smoothly mounted on the drawer 5 without receiving a pressing force from the pressing member 34A.

What is claimed is:

1. An image forming apparatus, comprising:

a housing;

a drawer movable between an inside position at which the drawer is located inside the housing, and an outside position at which the drawer is located outside the housing;

a drum cartridge mountable on the drawer and comprising a photoconductive drum rotatable about a first axis; and a developing cartridge mountable on the drawer and comprising a developing roller rotatable about a second axis, wherein the drum cartridge comprises a first developing-roller guide pivotable between (i) a first position at which the first developing-roller guide guides the developing roller when the developing cartridge is mounted on the drawer in a state in which the drum cartridge is mounted on the drawer, and (ii) a second position at which the first developing-roller guide guides the developing roller in a state in which the drum cartridge and the developing cartridge are mounted on the drawer, and wherein the second axis of the developing roller is located below the first axis of the photoconductive drum in a state in which the drum cartridge and the developing cartridge are mounted on the drawer, and the first developing-roller guide is located at the second position.

2. The image forming apparatus according to claim 1, wherein the drawer comprises a second developing-roller guide that guides the developing roller when the developing cartridge is mounted on the drawer, wherein the first developing-roller guide is connected to the second developing-roller guide in a state in which the drum cartridge is mounted on the drawer, and the first developing-roller guide is located at the first position, and wherein the first developing-roller guide is not connected to the second developing-roller guide in a state in which the drum cartridge is mounted on the drawer, and the first developing-roller guide is located at the second position.

3. The image forming apparatus according to claim 2, wherein the first developing-roller guide is located inside the housing, and at least a portion of the second developing-roller guide is located outside the housing in a state in which the drum cartridge is mounted on the drawer, and the drawer is located at the outside position.

4. The image forming apparatus according to claim 1, wherein the drawer comprises a lock member pivotable with the first developing-roller guide between a lock position at which the drum cartridge is locked to the drawer, and a lock release position at which lock of the drum cartridge to the drawer is released, in the state in which the drum cartridge is mounted on the drawer, and wherein the first developing-roller guide is located at the second position when the lock member is located at the lock position, and the first developing-roller guide is located at the first position when the lock member is located at the lock release position.

5. The image forming apparatus according to claim 4, wherein the drawer comprises a lever configured to cause the lock member to pivot from the lock position to the lock release position.

6. The image forming apparatus according to claim 5, wherein the lever is located outside the housing in a state in which the drawer is located at the outside position.

7. The image forming apparatus according to claim 5, wherein the drawer comprises a linking member that connects the lock member and the lever to each other.

8. The image forming apparatus according to claim 1, wherein the housing comprises a contact surface that contacts an end portion of the photoconductive drum in a state in which the drum cartridge is mounted on the drawer, and the drawer is located at the outside position, and the contact surface extends in a direction intersecting a moving direction of the drawer.

9. The image forming apparatus according to claim 1, wherein the developing cartridge is located outside the housing in a state in which the drum cartridge and the developing cartridge are mounted on the drawer, and the drawer is located at the outside position.

10. The image forming apparatus according to claim 1, wherein the photoconductive drum is located inside the housing in a state in which the drum cartridge and the developing cartridge are mounted on the drawer, and the drawer is located at the outside position.

11. The image forming apparatus according to claim 1, wherein the drum cartridge comprises a drum frame comprising the first developing-roller guide, and wherein the first developing-roller guide is pivotable between the first position and the second position by rotation of the drum frame with respect to the drawer in the state in which the drum cartridge is mounted on the drawer.

12. The image forming apparatus according to claim 1, further comprising a pressing member that holds the developing roller in contact with the photoconductive drum by pressing the developing cartridge in the state in which the drum cartridge and the developing cartridge are mounted on the drawer, and the first developing-roller guide is located at the second position.

13. The image forming apparatus according to claim 12, wherein the drawer comprises the pressing member.

14. An image forming apparatus, comprising:

a housing;

a drawer movable between an inside position at which the drawer is located inside the housing, and an outside position at which the drawer is located outside the housing;

a drum cartridge comprising a photoconductive drum rotatable about a first axis;

a developing cartridge comprising a developing roller rotatable about a second axis; and a first developing-roller guide configured to guide the developing roller and pivotable, in a state in which the drum cartridge is mounted on the drawer, between (i) a first position at which mounting and removal of the developing cartridge to and from the drawer are allowed and (ii) a second position at which mounting and removal of the developing cartridge to and from the drawer are not allowed, and a position of the developing roller is lower than that when the first developing-roller guide is located at the first position.

15. The image forming apparatus according to claim 14, wherein the second axis of the developing roller is located below the first axis of the photoconductive drum when the first developing-roller guide is located at the second position.

16. The image forming apparatus according to claim 14, wherein the first developing-roller guide comprises a recess in which an inserted portion that is a portion of the developing cartridge is to be inserted, wherein the drawer comprises a second developing-roller guide that guides the inserted portion of the developing cartridge when the developing cartridge is mounted on the drawer, wherein the first developing-roller guide located at the first position allows the inserted portion guided by the second developing-roller guide to be inserted in the recess, and wherein the first developing-roller guide located at the second position does not allow separation of the inserted portion inserted in the recess, from the recess to the second developing-roller guide.

17. The image forming apparatus according to claim 14, wherein the drawer comprises a lock member pivotable with the first developing-roller guide between a lock position at which the drum cartridge is locked to the drawer, and a lock release position at which lock of the drum cartridge to the drawer is released, in the state in which the drum cartridge is mounted on the drawer, and wherein the first developing-roller guide is located at the second position when the lock member is located at the lock position, and the first developing-roller guide is located at the first position when the lock member is located at the lock release position.

* * * * *